United States Patent [19]

Brun

[11] 4,456,948

[45] Jun. 26, 1984

[54] MOTOR VEHICLE HEADLAMP WITH A NARROW OUTLET WINDOW

[75] Inventor: Norbert Brun, Bobigny, France

[73] Assignee: Cibie Projecteurs, Bobigny, France

[21] Appl. No.: 367,777

[22] Filed: Apr. 12, 1982

[30] Foreign Application Priority Data

Apr. 14, 1981 [FR] France ..... 81 07474

[51] Int. Cl.[3] ..... F21V 7/00

[52] U.S. Cl. ..... 362/268; 362/61; 362/83; 362/298; 362/299; 362/300; 362/301; 362/307; 362/308; 362/310; 362/311; 362/328; 362/331; 362/335; 362/339; 362/340; 362/346; 362/347; 362/350

[58] Field of Search ..... 362/268, 61, 83, 298, 362/299, 300, 301, 307, 308, 310, 311, 328, 331, 335, 339, 340, 346, 347, 350

[56] References Cited

U.S. PATENT DOCUMENTS

| | | | |
|---|---|---|---|
| 981,290 | 1/1911 | Lebby | 362/347 |
| 1,363,583 | 12/1920 | Gallaher . | |
| 1,419,482 | 6/1922 | Wood . | |
| 3,443,086 | 5/1969 | Rikis | 362/347 |

FOREIGN PATENT DOCUMENTS

| | | |
|---|---|---|
| 865068 | 5/1941 | France . |
| 1039135 | 10/1953 | France . |
| 1214367 | 4/1960 | France . |
| 1511623 | 2/1968 | France . |
| 2245912 | 4/1975 | France . |

*Primary Examiner*—Stephen J. Lechert, Jr.

[57] ABSTRACT

A motor vehicle headlamp comprising in combination an optical system for recovering flux having a rectilinear focal segment and an optical system for rectifying images having a focal segment coinciding with the former and able to produce a beam of rays of controlled directivity passing through a narrow light window, while preserving a high luminous efficiency. The flux recovery system is constituted by an elliptical paraboloid, an hyperbolic paraboloid or their optical equivalents. By using various combinations of optical elements, it is possible to arrange the flux recovery system both in the axis of the rays leaving the headlamp, as well as on the side of the body work or on the lower part of the latter.

6 Claims, 58 Drawing Figures

MOTOR VEHICLE HEADLAMP WITH A NARROW OUTLET WINDOW

Figure 1A:
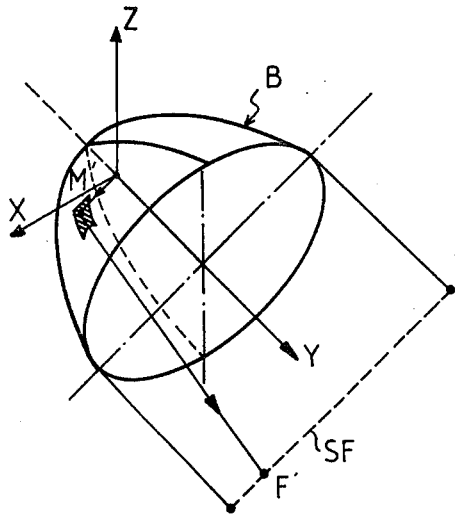

The present invention relates to motor vehicle headlamps.

Motor vehicle headlamps known hitherto, whether it is a question of headlamps having a main beam and dipped beam, high beam headlamps or even fog lamps, are most frequently constituted by a light source, a reflector, whereof the focus is close to said light source and a closing glass, provided if desired with optical reliefs ensuring the diffusion of the light flux emitted by the source and reflected by the reflector.

The reflector generally comprises a parabolic reflecting surface, constructed as one or more sectors of a paraboloid.

It is essential that the reflector is struck by a maximum of the light flux emitted by the light source and that it reflects it towards the glass with the suitable directivity.

For example, for a main beam headlamp, the reflector must reflect a very directive beam of light rays, i.e. a beam constituted by rays which are all substantially parallel to the direction of emission. For a dipped beam, the directivity must be less, the light rays having to constitute a slightly convergent beam.

During recent years, it has become extremely desirable to produce motor vehicle headlamps whereof the outlet window (corresponding substantially to the contour of the closing glass), is very narrow, i.e. of no height with respect to its transverse dimension or width. Headlamps of this type of the "strip of light" type are in great demand by motor vehicle manufacturers, owing to the fact that narrow outlet windows provide the designer with new possibilities in that they can be integrated particularly well in the line of certain modern cars.

To produce headlamps of this type, the pure and simple transposition of traditional arrangements is not satisfactory, in particular in the field of optical efficiency. In fact, if a headlamp having a narrow window is produced with a conventional reflector of the parabolic type, of low height and great width, only a very small part of the flux emitted by the light source is recovered. On the other hand, studies carried out by the Applicant have shown that this situation is scarcely improved when the reflector is constituted by a plurality of parabolic sectors, or more generally, when the latter is given a relatively flattened shape diverging from the traditional parabolic shape. Very briefly, it can be stated that the two conditions for good recovery of the flux, on the one hand and good directivity, on the other hand, are not easily compatible, when a single reflector is used for cooperating with the source.

The present invention proposes a general solution to this problem, concerning all types of headlamps, as well as particular solutions more specifically suitable for the construction of a particular type of headlamp.

The basic idea of the invention resides in the dissociation of the two functions of recovering the light flux emanating from the light source and rectifying images, in order to make the beam suitably directive (i.e. parallel to the direction of emission in the case of main beam and slightly convergent in the case of dipped beam).

In order to do this, according to the invention, two optical systems are used in combination, which successively treat the light rays emitted by the source, each of the two systems comprising a rectilinear focal segment, the focal segments of the two systems being substantially merged.

More precisely, the headlamp according to the invention comprises, in combination:

(a) an optical system recovering the flux generating a real or virtual line of foci. This line of foci—which will be referred to hereafter in the text by the name of "focal segment"—is transverse with respect to the optical axis of the flux recovery means. In the case where this focal segment is horizontal, its length is equal to the width of the outlet window of the headlamp; in the case where this focal segment is vertical, its length is equal to the height of the outlet window of the headlamp. A system of this type is thus able to create from a substantially pinhole light source, a beam of light rays all passing through the focal segment whilst all being substantially parallel to the direction of the plane perpendicular to the focal segment.

(b) An optical system for rectifying images having a focal segment coinciding with the former and able to transform the beam leaving the system for recovering flux into a beam having controlled directivity.

In this case it is important to note that optical systems comprising focal segments have already been proposed, in particular in the construction of motor vehicle headlamps. But these focal segments are most frequently axial and not transverse. Indeed, in the case where they are transverse, they never use the fundamental property of the mirror for recovering flux, which is to create a line of foci and to use this "line of light" as a special source of a second optical system capable of rectifying all the light rays perfectly. Thus, within the knowledge of the Applicant, it has never been proposed to use the combination of systems whereof the focal segments coincide with the above mentioned separation of the functions.

As will be seen hereafter, the constitution of the two optical systems may be effected in various ways.

For a general explanation of the invention, it is sufficient to state that the focal segment which is common to the two systems may be vertical, or equally well horizontal; similarly, it may be real or virtual for one and/or the other of the systems.

In addition to the features and advantages described above, which are fundamental, the new structure of headlamp according to the invention, owing to the fact that it comprises two optical systems, is suitable for various topological arrangements.

In fact, as will be seen more completely hereafter, whereas the system for rectifying images has its optical axis in the direction of emission, merging with the axis of the motor vehicle, the system for recovering flux may have various arrangements: it may itself be located in the axis of emission; it may be located laterally on the side of the body-work of the vehicle with its transverse optical axis; it may be located on the lower part of the bodywork of the vehicle with its vertical optical axis. This gives rise to various possibilities of implantation on the bodywork of a motor vehicle.

Figure 1B:
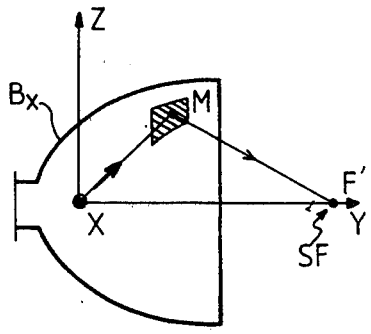
Figure 1C:
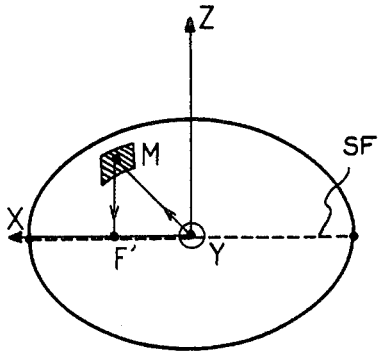
Figure 1D:
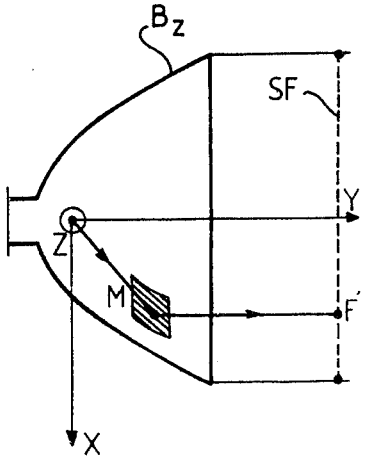
Figure 2A:
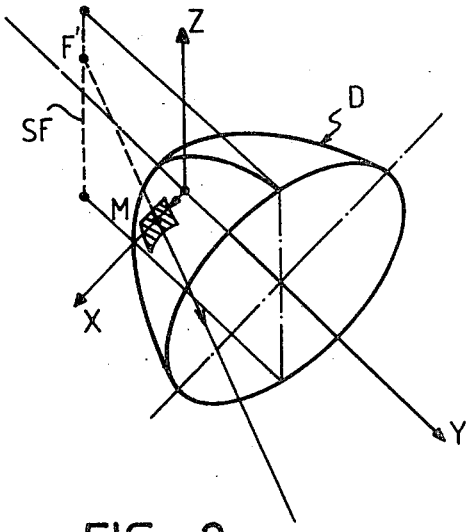
Figure 2B:
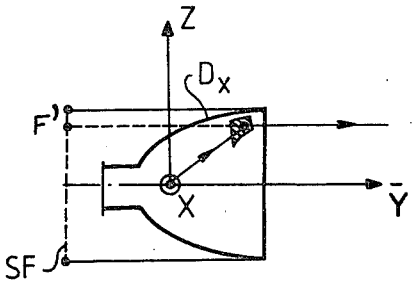
Figure 2C:
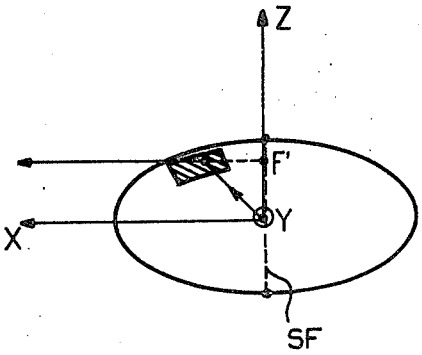
Figure 2D:
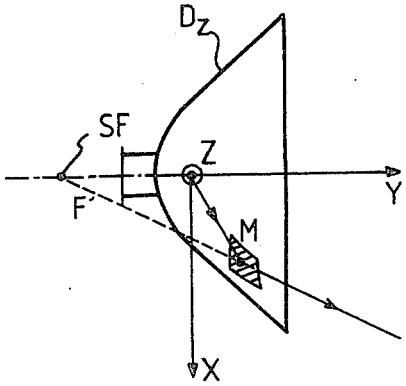
Figure 3:
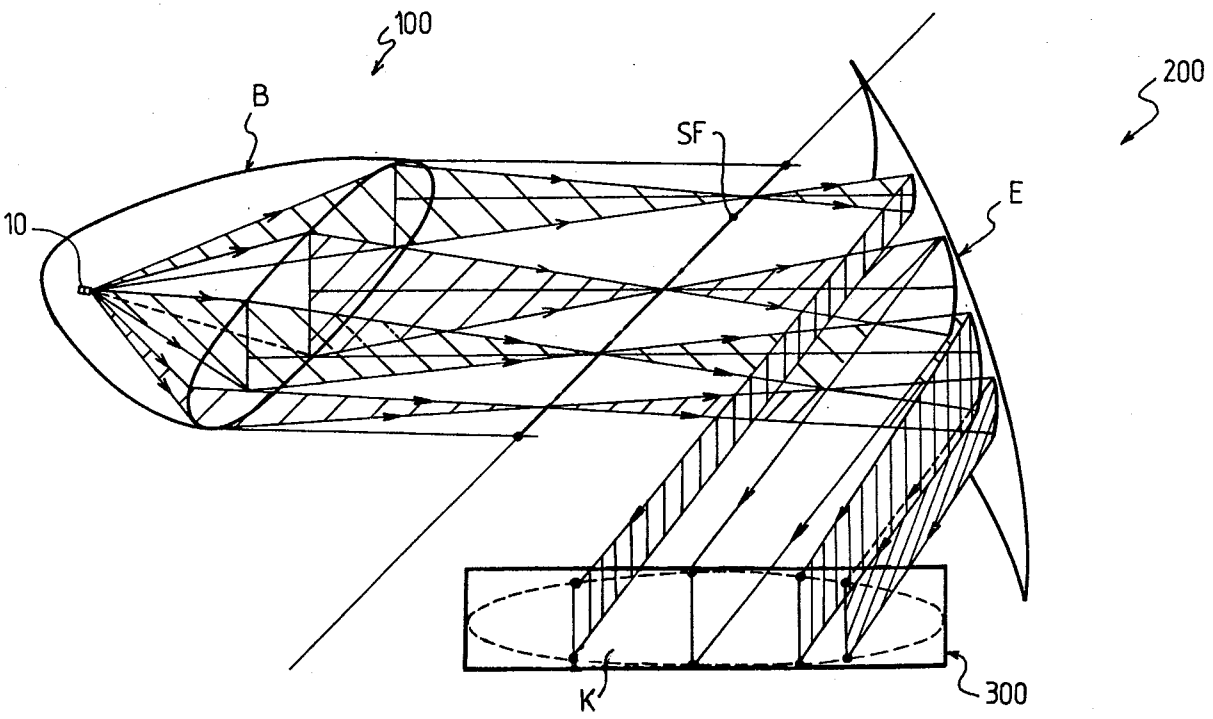
Figure 4:
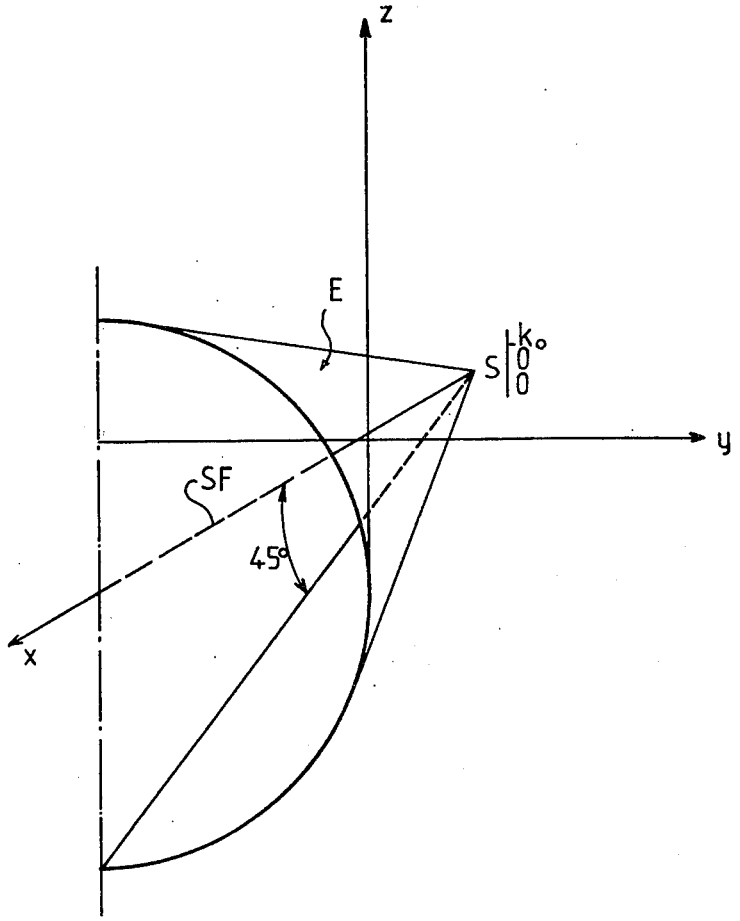
Figure 5:
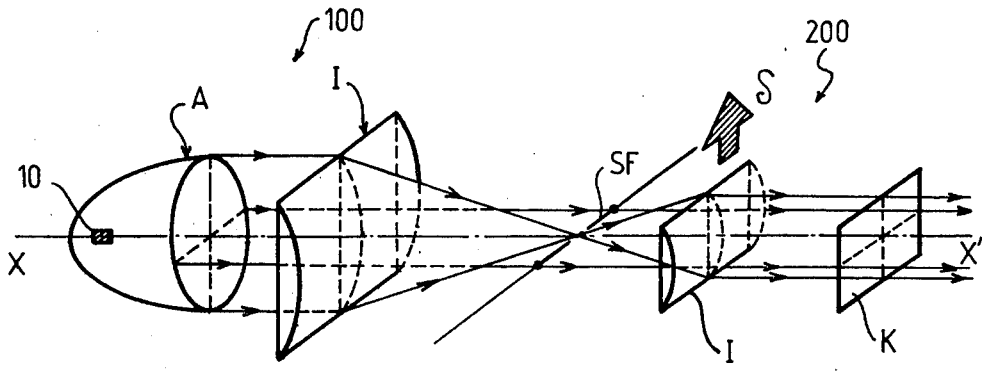
Figure 6:
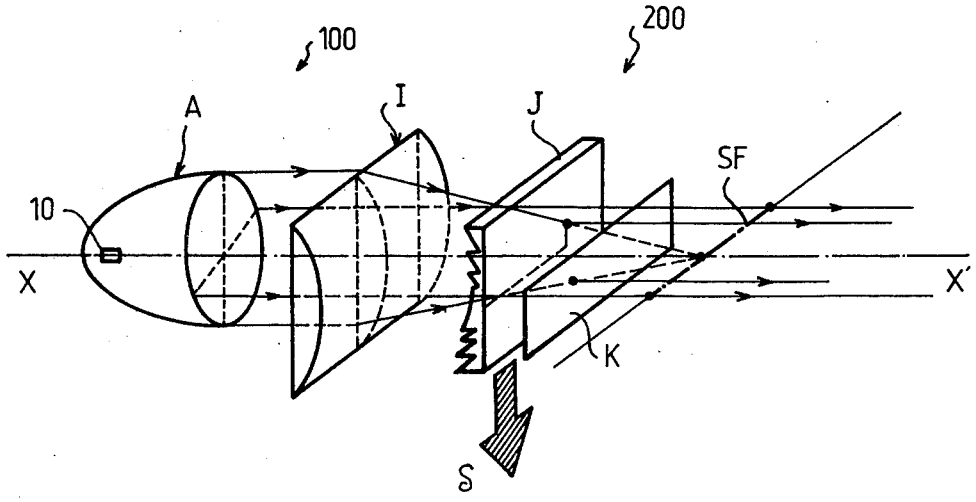
Figure 7:
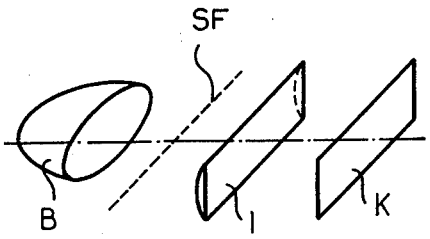
Figure 7A:
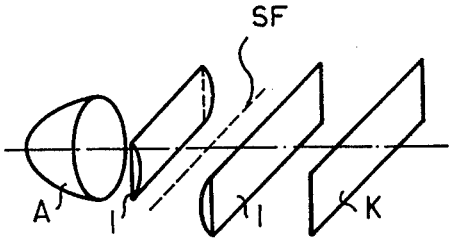
Figure 8:
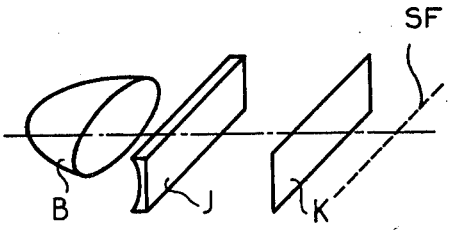
Figure 8A:
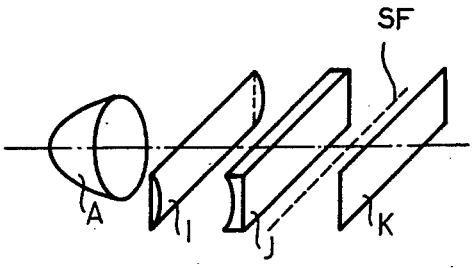
Figure 9:
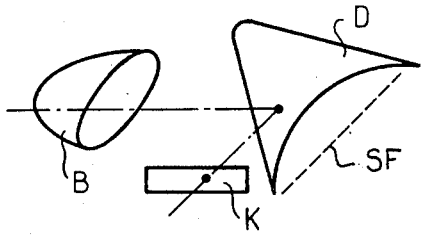
Figure 9A:
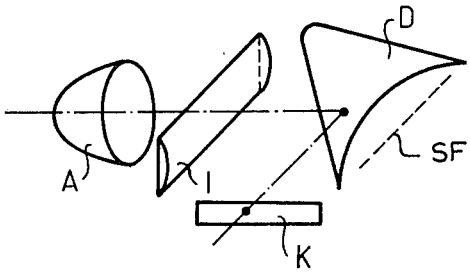
Figure 10:
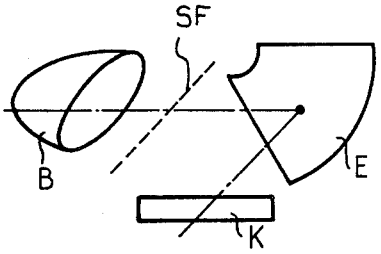
Figure 10A:
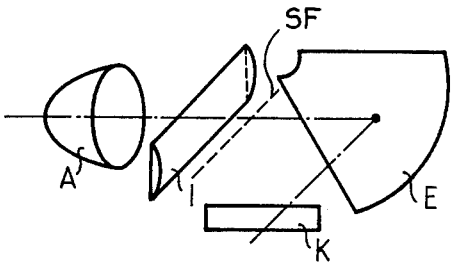
Figure 11:
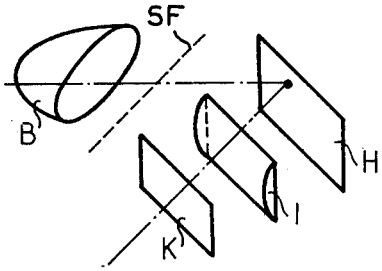
Figure 11A:
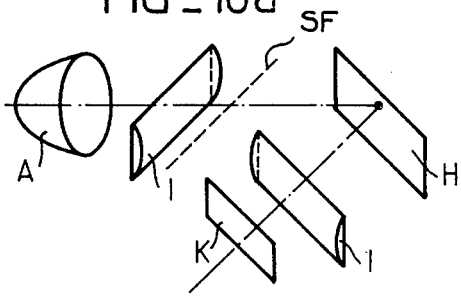
Figure 12:
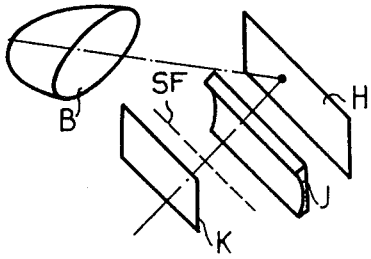
Figure 12A:
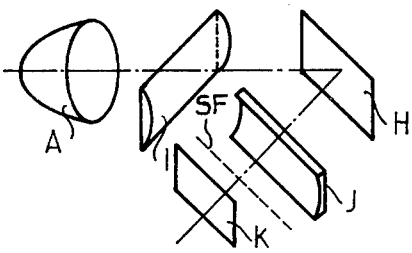
Figure 13:
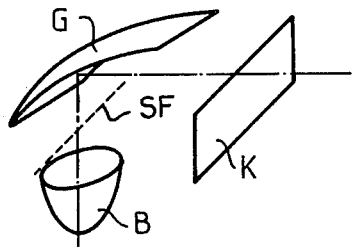
Figure 13A:
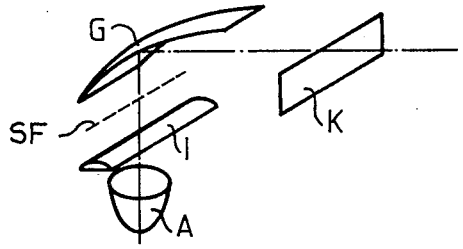
Figure 14:
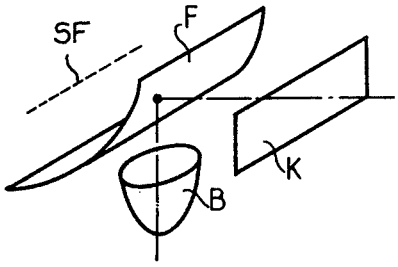
Figure 14A:
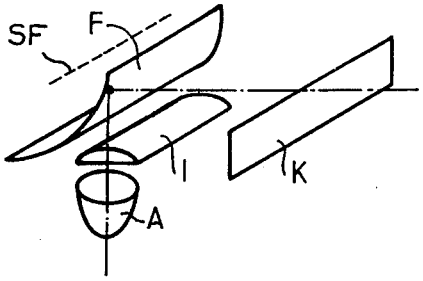
Figure 15:
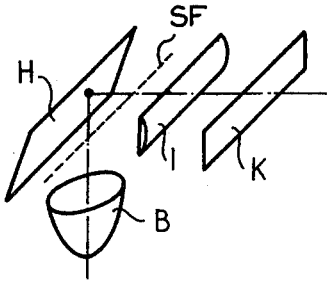
Figure 15A:
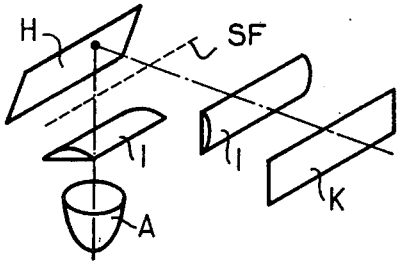
Figure 16:
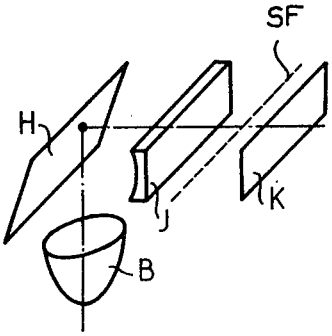
Figure 16A:
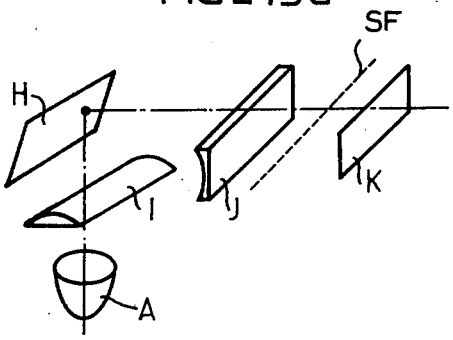
Figure 21:
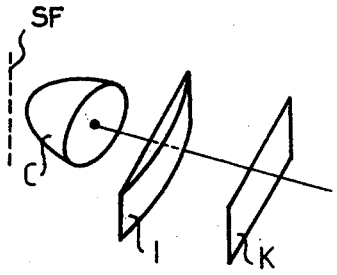
Figure 21A:
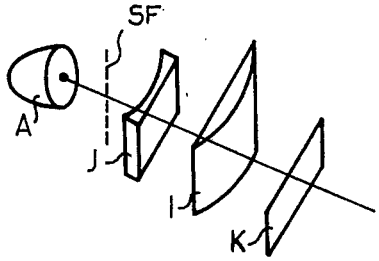
Figure 22:
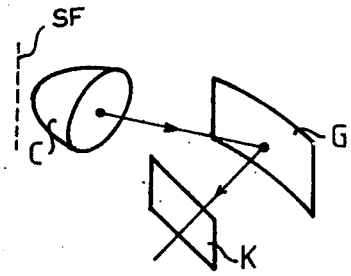
Figure 22A:
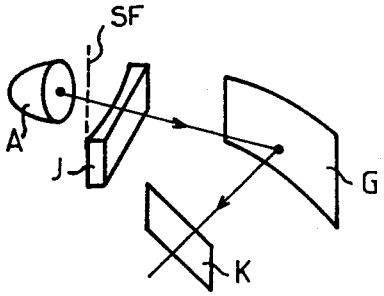
Figure 23:
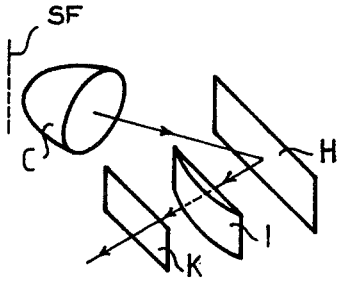
Figure 23A:
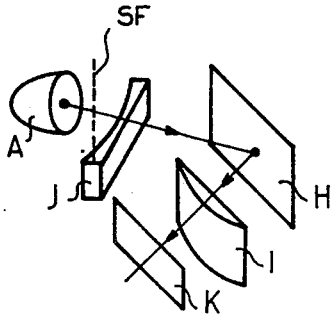
Figure 24:
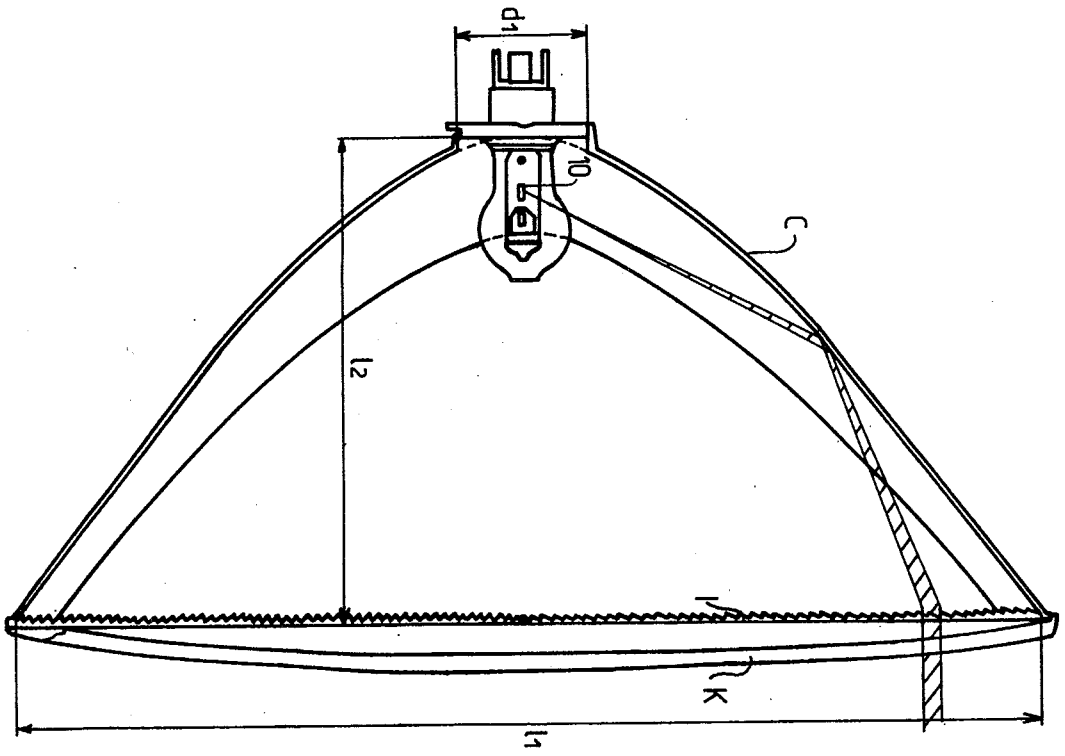
Figure 25:
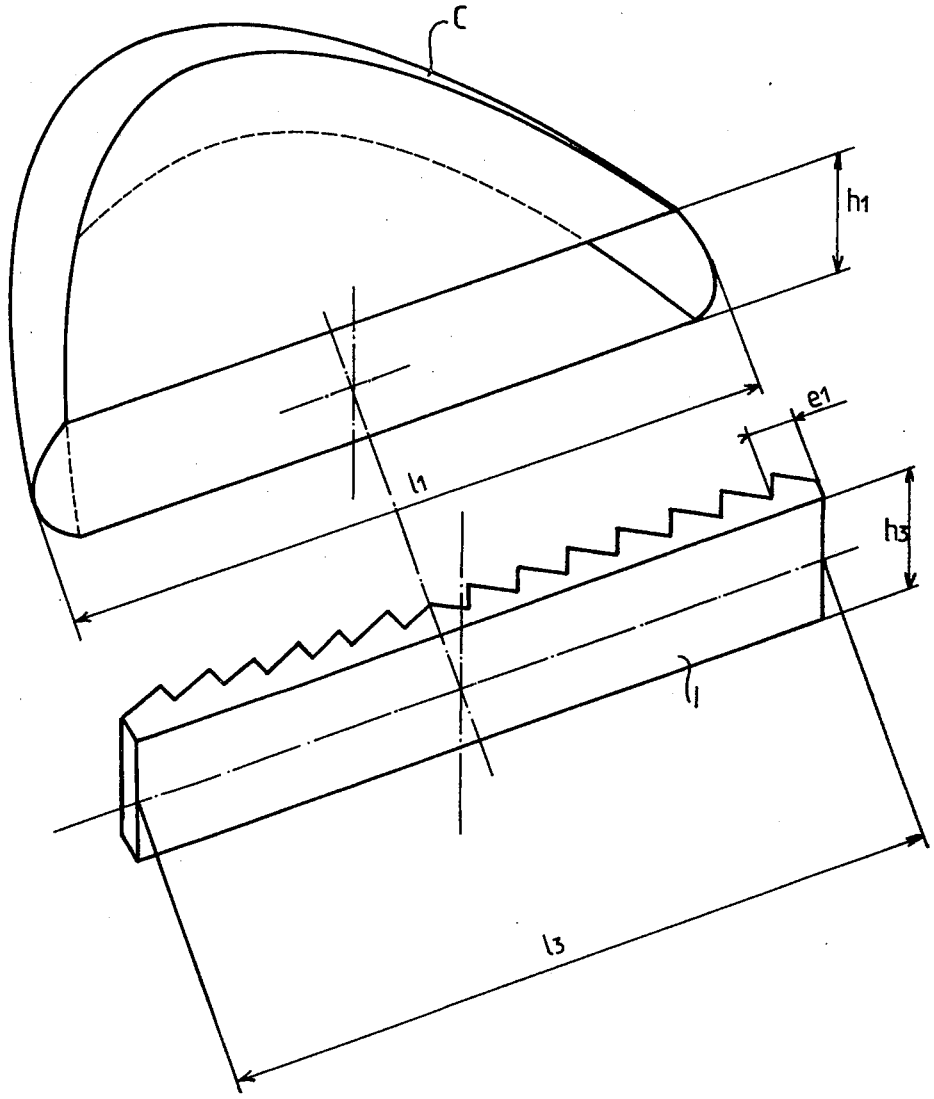
Figure 26A:
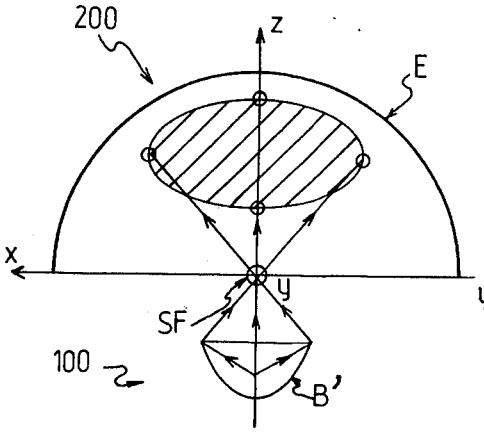
Figure 26B:
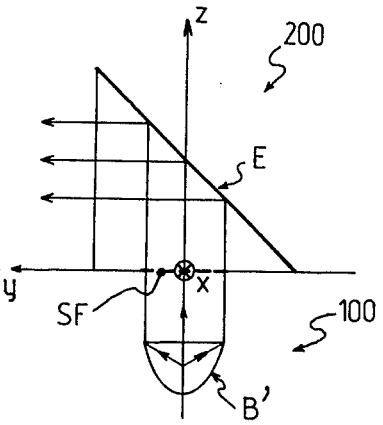
Figure 26C:
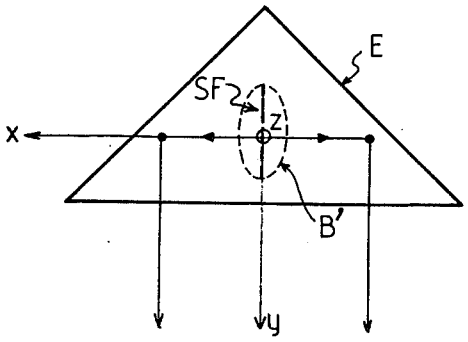
Figure 27:
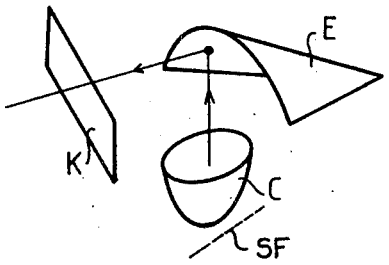
Figure 27A:
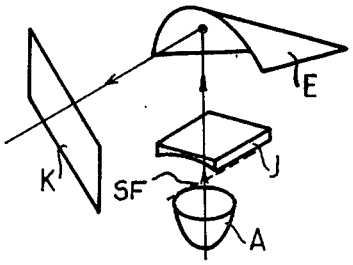
Figure 28:
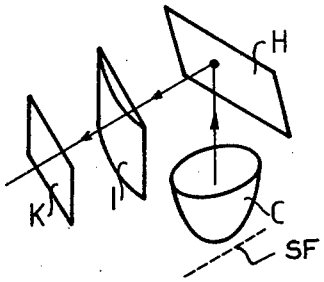
Figure 28A:
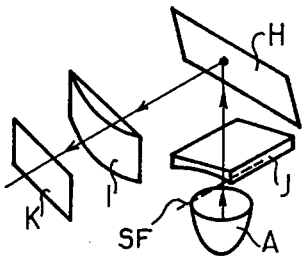
Figure 29:
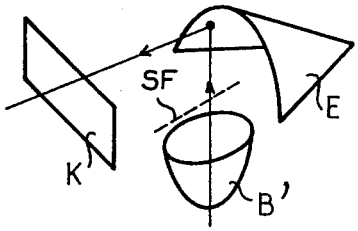
Figure 29A:
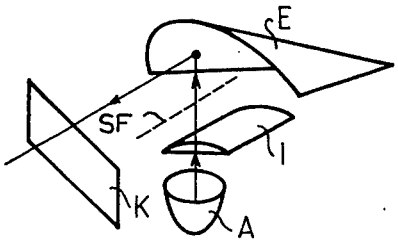
Figure 30:
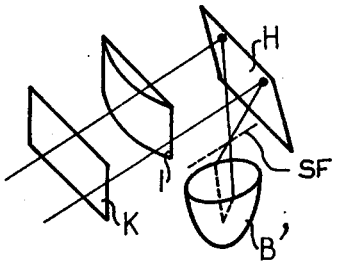
Figure 30A:
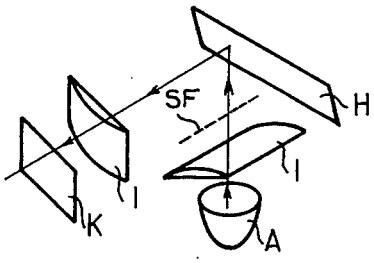

Further features and advantages of the invention will become apparent from the ensuing description, referring to the accompanying drawings, the structure of the invention being given therein in a certain number of non-limiting examples. In the accompanying drawings:

FIG. 1*a* is an axonometric perspective of an elliptical paraboloid of the first type, shown in a trirectangular trihedron OXYZ, FIGS. 1*b*, 1*c* and 1*d* are sections of this same surface respectively through the planes YOZ, XOZ and XOY, FIG. 2*a* is an axonometric perspective of a hyperbolic paraboloid, shown in a trirectangular trihedron OXYZ, FIGS. 2*b*, 2*c* and 2*d* are sections of this same surface respectively through the planes YOZ, XOZ and XOY, FIG. 3 shows the basic structure according to the invention, FIG. 4 is an isometric perspective of a convergent cone used in this structure, FIG. 5 shows a first optical equivalent of the structure of FIG. 3, FIG. 6 shows a second optical equivalent of the structure of FIG. 3, FIG. 7 to 16 and 7*a* to 16*a* shows two series of variations of the basic structure, FIG. 17 relates to a second type of construction of the structure according to the invention, FIGS. 18 to 20 and 18*a* to 20*a* define two series of variations of such a structure, FIGS. 21 to 23 and 21*a* to 23*a* show two other series of variations, relating to a third method of construction, FIG. 24 is an axial section of one embodiment of the invention, FIG. 25 is a perspective view of this same embodiment, FIGS. 26*a* to 26*c* relate to a fourth type of construction of a structure according to the invention, FIGS. 27 to 30 and 27*a* to 30*a* illustrate two series of variations of this fourth type.

Before undertaking a systematic explanation of the invention, we shall firstly define the various optical elements which may be used for the constitution of the optical system for recovering flux and the optical system for rectifying images according to the invention.

A paraboloid of revolution—symbol A—is understood to mean a mirror whereof the reflecting surface is obtained by the rotation of a parabola about its focal axis. A reflecting surface of this type comprises a real focus, the light rays emanating from the focus being reflected parallel to the axis of the paraboloid.

An elliptical paraboloid of the first type—symbol B—is understood to mean a reflecting surface comprising a real horizontal focal segment (FIGS. 1*a* to 1*d* illustrate such a surface). In order words, the light rays, emanating from a substantially pinhole source, are reflected as a beam of rays which all converge towards the focal segment SF, whilst all being parallel to the direction of planes perpendicular to the focal segment. If one wishes to define such a surface mathematically in a trirectangular trihedron (XYZ, in which the axis Z is vertical, the axis Y transverse and the axis X longitudinal, a surface of this type is defined by the following equation:

$$[x^2+2cy+k^2_o-c^2]^2=4\,k^2_o(x^2+y^2+z^2),$$

$k_o$ and c being characteristic constants of the mirror.

It can be shown easily that the vertical meridian $B_x$ of such a surface is an ellipse, whereas the horizontal meridian $B_z$ is a parabola.

The term elliptical paraboloid of the second type—symbol B'—is understood to mean a reflecting surface identical to the former, but whereof the real focal segment is on this occasion vertical (the preceding surface has been turned through a quarter of a revolution). The term hyperbolic paraboloid—symbol C—is understood to mean a reflecting surface having a vertical and virtual focal segment (FIGS. 2*a* 2*d*). This means that the light rays emitted by a substantially pinhole source and reflected by a surface of this type constitute a beam whereof all the rays seem to come from the focal segment SF, whilst being parallel to the direction of a plane perpendicular to the focal segment, i.e. to the horizontal plane. If this is to be defined as previously, in a trirectangular trihedron XYZ, a surface of this type is generally of the equation:

$$(z^2-2cy+k^2_o-c^2)^2=4\,k^2_o(x^2+y^2+z^2)$$

$k_o$ and c being characteristic constants of the mirror.

It can be shown easily that the horizontal meridian $D_z$ of such a surface is a hyperbola, whereas the vertical meridian $D_x$ is a parabola.

The term divergent cone—symbol D—is understood to mean a reflecting surface having the geometric shape of a cone of revolution and which is struck from the outside by the light rays.

A convergent cone—symbol E—is understood to mean a reflecting surface having the geometric shape of a cone of revolution and which is struck from the inside by the light rays.

A cylindrical mirror having a divergent parabolic profile—symbol F—is understood to mean a reflecting surface defined geometrically as a cylinder whereof the directrix is parabolic and whereof the convexity is directed towards the light source.

A cylindrical mirror having a convergent parabolic profile—symbol G —is understood to mean a reflecting surface defined geometrically as a cylinder, whereof the directrix is a parabola and which turns its concavity towards the light source.

It is also known that a plane mirror inclined at an angle of 45°—symbol H—with respect to incident light rays, deflects them by a right angle. Furthermore, a man skilled in the art knows without hesitating what is a convergent cylindrical lens—I—, a divergent cylindrical lens—J-13 and a convergent Fresnel lens—also bearing the reference I-13 or a divergent Fresnel lens—J. Finally, the reference K will designate the aforesaid headlamp closing glass of known type.

Since the basic optical elements which have been used in the systems of the invention have thus been defined and designated by symbols, various embodiments of the invention will be described in succession.

FIG. 3 shows the basic structure according to the invention.

It is a question of obtaining from a substantially pinhole light source 10, which is for example the filament of a bulb, a beam of controlled directivity and this is through an outlet window 300 of elongated rectangular shape, as illustrated.

According to the invention, a system for recovering flux 100 comprising a horizontal focal segment SF is used in cooperation with the light source 10. This system for recovering flux is an elliptical paraboloid of the first said type (B). Its surface envelopes the light source 10 over a large solid angle, so that the essential portion of the flux emanating from the source is recovered by the elliptical parabolic mirror B. The beam which it reflects is constituted by rays which all converge on the focal segment SF, whilst all being parallel to the direction of a plane perpendicular to SF. The light rays are then picked up by an optical system 200 for rectifying images, which gives them their desired directivity, by returning them to infinity if a main beam is desired and by returning them with a slight convergence if a less directive beam is desired. The system for rectifying images also has a focal segment coinciding with SF.

When one wishes to obtain an exactly directive beam, for example a main beam, the system 300 is advantageously a convergent cone (E), whereof the axis of revolution coincides with the focal segment SF, the half-angle at the vertex of the cone being 45°.

The equation of such a cone, illustrated in FIG. 4, is of the type:

$y^2+z^2-(x+k_o)^2=o$ small $k_o$ being a constant dependent on the geometry of the apparatus.

From the optical point of view, it can be noted that a cone of this type is the equivalent of the association of a plane mirror inclined by 45° with respect to the X-axis and perpendicular to the plane XY, with a cylindrical lens.

If one now wishes to obtain a dipped beam, i.e. a slightly convergent beam, it is possible to preserve the preceding elements, whilst moving the light source 10 slightly on the axis of the elliptical paraboloid 100. A movement of this type will cause a vertical convergence of the beam reflected by the elliptical paraboloid and vertical spreading-out of the beam reflected by the cone. It is thus sufficient to provide the window 300 with a closing glass K causing lateral spreading-out of the beam, in order to obtain the desired spreading in all directions.

Another more rigorous solution consists of producing the system 200 in the form of an elliptical paraboloid of the first type (B) naturally having different parameters to those of the system 100.

It is important to note that the beam which has been defined has its contour geometrically determined by the parameters of the first elliptical paraboloid 100. In fact it is a question of a pseudo-ellipse (shown in dotted line in FIG. 3), which is inscribed in the window 300. In all the previously described cases, the system 200 for recovering flux is limited by two horizontal parallel planes and two vertical parallel planes.

It should be noted here that optical equivalents exist and that the aforesaid functions can be accomplished with other elements. Thus, an elliptical paraboloid of the first type (B) is equivalent to the association of a parabolic mirror (A) and of a convergent cylindrical lens (I). Similarly, the previously defined cone (respectively D or E) is equivalent to the association of a plane mirror inclined through 45° (H) and a cylindrical lens (respectively divergent (J) or convergent (I)) focussed on the focal segment SF. By virtue of these equivalences, it is possible to define other embodiments, always comprising a system for recovering flux and a system for rectifying images, both having a focal segment SF.

FIG. 5 shows an equivalent solution of this type, all the optical elements having the same optical axis, which is the axis of the headlamp. The system 100 for recovering flux is constituted by the association of a parabolic mirror A and of a convergent cylindrical lens I, whereas the system 200 for rectifying images is constituted by a convergent cylindrical lens I. In this respect, it should be noted that a movement of this convergent lens I in the direction S perpendicular to the optical axis XX' allows an adjustment of the inclination in height of the light rays, i.e. an adjustment of the "masking".

In FIG. 6, the system for recovering flux is as has been described, but the system for rectifying images is on this occasion constituted by a divergent Fresnel lens J having S-F as a virtual focus. Here too, this lens may serve for adjusting masking.

The various solutions which can be achieved with a system for recovering flux constituted by an elliptical paraboloid of the first type are illustrated in FIGS. 7 to 16 with the previously mentioned symbolism. In addition to the in-line arrangements (FIGS. 7,8), it is possible to use arrangements in which the axis of the system for recovering flux is perpendicular to the axis of emission, either below (recovery of flux at the bottom of the bodywork, see FIGS. 13 to 16), or from the side (flux recovery means located laterally, see FIGS. 9 to 12). FIGS. 7*a* to 16*a* are equivalent solutions to those of FIGS. 7 to 16, in which the elliptical paraboloid (B) is replaced by the combination of a paraboloid of revolution (A) and a convergent lens (I).

Hitherto, embodiments have been described using a real focal segment for a flux recovery system constituted by an elliptical paraboloid of the first type (B) i.e. with a horizontal axis. A second type of construction, which will now be described, uses an elliptical paraboloid of the second type (B'), i.e. a vertical focal segment. FIG. 17 illustrates such an arrangement. In this case, since the focal segment SF, defined as previously, is vertical, the system for rectifying images is constituted, as illustrated, by a convergent cylindrical lens (I) having a vertical axis, 250. This lens has a focal line coinciding with SF. A distribution glass may be used to give the beam any desired diffusion.

By utilizing optical equivalents within the knowledge of a man skilled in the art, other equivalent constructions may also be provided. FIGS. 18 to 20 illustrate different variations, the letters being used with the symbolism mentioned at the beginning of this description. FIGS. 18*a* to 20*a* are the counterparts to FIGS. 18 to 20, the elliptical paraboloid (B') for recovering flux being replaced by the combination of a paraboloid of revolution (A) and a convergent lens (I).

Hitherto, the cooperation of a flux recovery system and of a system for rectifying images having the same focal segment has been explained, this focal segment being real for the flux recovery system.

In a third major type of construction, it is possible to use a flux recovery system having a virtual focal segment, since this is constructed in the form of a hyperbolic paraboloid (C), or of all these optical equivalents. FIGS. 21 to 23 and 21*a* to 23*a* illustrate these arrangements, with the symbolism of letters explained previously.

One embodiment of the invention will now be described with reference to FIGS. 24 (axial section) and 25 (perspective). In this case, as shown, the flux recovery system is a hyperbolic paraboloid mirror (C) having a vertical virtual focus, which has the following charcteristics:

opening : $1_1=310$ mm,
height : $h_1=95$ mm,
depth : $1_2=150$ mm,
diameter of the hole in the base : $d_1=40$ mm,
focus : 18 $mm_2$,
constant $k_o$ : 151 $mm^2$,
constant c : 187 mm.

In turn, the system for rectifying images is a cylindrical Fresnel lens (I) located in front of the hyperbolic paraboloid mirror and having the following characteristics:

opening : $1_3=1_1=310$ mm,
height : $h_3=h_1=95$ mm, focus : 319 mm,
pitch of the prisms : $e_1 = 3$ mm.

If one wishes to reduce losses due to clearances, it is possible to orientate the prisms towards the outside of the mirror and not towards the inside as shown in FIG. 25.

FIG. 24 shows the path of the pencils of light coming from the filaments of a bulb constituting the light source 10. FIG. 25 illustrates the numerical parameters used.

A prototype constructed according to FIGS. 24 and 25 was completely satisfactory, with a very good recovery of the flux emitted by the bulb and excellent directivity, even when the opening window had a width more than three times greater than its height.

FIGS. 26*a*, 26*b*, 26*c* illustrate a fourth major type of construction, in three diagrammatic views, in which the flux recovery system 100 is an elliptical paraboloid (B') of the second type defined previously, orientated such that its axis of symmetry is directed vertically.

This elliptical paraboloid B' forming the flux recovery means generates a focal segment SF which is in its optical axis. The image rectifying means 200 are a convergent cone (E) with a half-angle at the vertex of 45° and having its axis along SF.

FIGS. 27 to 30 and 27*a* to 30*a* illustrate eight variations of the fourth type of construction.

Naturally, the invention is not limited to the embodiments described, but extends to all variations in accordance with its spirit, which is the association of two systems having the same focal segment, one for the recovery of the flux, the other for rectifying images, i.e. a correction of the divergence of the rays of the first system in order to give the beam finally emitted the suitable directivity. It seems important to stress the fact that an association of this type appears novel, although mirrors comprising a focal segment, used separately as the main element of headlamps have already been proposed, for example in French Pat. No. 1 039 135.

Any group of symbolic letters appearing in a figure is there to define a particular combination which forms an integral part of the invention.

What is claimed is:

1. A motor vehicle headlamp comprising in combination (a) an optical system for recovering flux, chosen from the group consisting of elliptical and hyperbolic paraboloids of the fourth degree, said flux recovery system having a rectilinear first focal segment so as to be able to create from a substantially pinhole light source a beam of light rays all passing through the focal segment and all being substantially parallel to the direction of a plane perpendicular to the focal segment, and (b) an optical system for rectifying images having a second focal segment coinciding with the first focal segment and able to transform the beam leaving the flux recovery system into a beam of rays having controlled directivity passing through a narrow light window.

2. A motor vehicle headlamp according to claim 1 wherein said focal segment is horizontal with a dimension equal to the width of the light window.

3. A motor vehicle headlamp according to claim 1, wherein said focal segment is vertical with a dimension equal to the height of the light window.

4. A motor vehicle headlamp according to claim 1, wherein said the focal segment is axial.

5. A motor vehicle headlamp according to claim 1, comprising one of the following optical combinations:

| | |
|---|---|
| BIK | AIIK |
| BJK | AIJK |
| BDK | AIDK |
| BEK | AIEK |
| BHIK | AIHIK |
| BHJK | AIHJK |
| BGK | AIGK |
| BFK | AIFK |
| BHIK | AIHIK |
| BHJK | AIHJK |
| B'IK | AIIK |
| B'GK | AIGK |
| B'HIK | AIHIK |
| CIK | AJIK |
| CGK | AJGK |
| CHIK | AJHIK |
| CEK | AJEK |
| CHIK | AJHIK |
| B'EK | AIEK |
| B'HIK | AIHIK, |

wherein

A is a paraboloid of revolution meaning a mirror whereof the reflecting surface is obtained by the rotation of a parabola about its focal axis;

B is an elliptical paraboloid of the first type meaning a reflecting surface comprising a real horizontal focal segment;

B' is an elliptical paraboloid of the second type—meaning a reflecting surface identical to that of B but whereof the real focal segment is vertical;

C is a hyperbolic paraboloid meaning a reflecting surface having a vertical and virtual focal segment;

D is a divergent cone meaning a reflecting surface having the geometric shape of a cone of revolution and which is struck from the outside by the light rays;

E is a convergent cone meaning a reflecting surface having the geometric shape of a cone of revolution and which is struck from the inside by the light rays;

F is a cylindrical mirror having a divergent parabolic profile meaning a reflecting surface defined geometrically as a cylinder whereof the directrix is parabolic and whereof the convexity is directed towards the light source;

G is a cylindrical mirror having a convergent parabolic profile meaning a reflecting surface defined geometrically as a cylindrical, whereof the directrix is a parabola and which turns its concavity towards the light source;

H is a plane mirror inclined at an angle of 45° with respect to incident light rays and deflects them by a right angle;

I is a convergent cylindrical lens or a convergent Fresnel lens;

J is a divergent cylindrical lens or a divergent Fresnel lens;

K is a headlamp closing glass.

6. A headlamp according to any one of claims 1 to 5 wherein said flux recovery system is located in the axis of the light rays emanating from the headlamp.

* * * * *